US005435373A

United States Patent [19]

Drane et al.

[11] Patent Number: 5,435,373

[45] Date of Patent: Jul. 25, 1995

[54] APPARATUS AND METHOD FOR LUBRICATING AND CLEANING OUT DIE-CASTING EQUIPMENT

[75] Inventors: Donald L. Drane, New Kensington, Pa.; James R. Fields, Soest, Germany; Robert C. Wallace, New Kensington; Thomas J. Kasun, Pittsburgh, both of Pa.; Robert E. Robinson, Maryville, Tenn.

[73] Assignee: Aluminum Company of America, Pittsburgh, Pa.

[21] Appl. No.: 122,999

[22] Filed: Sep. 17, 1993

Related U.S. Application Data

[63] Continuation-in-part of Ser. No. 754,993, Sep. 6, 1991, Pat. No. 5,246,055, which is a continuation-in-part of Ser. No. 320,140, Mar. 7, 1989, Pat. No. 5,076,344.

[51] Int. Cl.[6] ..... B22D 17/20

[52] U.S. Cl. ..... 164/72; 164/149; 164/158; 164/267; 164/312

[58] Field of Search ..... 164/72, 74, 149, 158, 164/267, 312

[56] References Cited

U.S. PATENT DOCUMENTS

| | | | |
|---|---|---|---|
| 3,209,416 | 10/1965 | Morton . | |
| 3,254,377 | 6/1966 | Morton . | |
| 3,544,355 | 12/1970 | Ott . | |
| 3,920,099 | 11/1975 | Pondelicek et al. | 184/55 |
| 4,223,718 | 9/1980 | Miki et al. | 164/149 |
| 4,562,875 | 1/1986 | Ogoshi et al. | 164/72 |
| 4,605,170 | 8/1986 | Thurner | 239/444 |
| 4,738,297 | 4/1988 | Takagi et al. | 164/72 |

FOREIGN PATENT DOCUMENTS

| | | | |
|---|---|---|---|
| 2526901 | 1/1977 | Germany | 164/158 |
| 53-46779 | 12/1978 | Japan . | |
| 57-70070 | 4/1982 | Japan | 164/158 |
| 62-118955 | 5/1987 | Japan . | |
| 306163 | 7/1971 | U.S.S.R. . | |
| 662257 | 5/1979 | U.S.S.R. | 164/267 |

*Primary Examiner*—J. Reed Batten, Jr.
*Attorney, Agent, or Firm*—Thomas R. Trempus; Richard V. Westerhoff

[57] ABSTRACT

The fill chamber bore of a die-casting machine is lubricated and prepared for casting by inserting an elongated member into the die-end of the bore while spraying with lubricant. During withdrawal of the elongated member, a conical spray of gas directed toward the die-end drys the lubricant and sweeps vapor and flash, or solder, out of the die-end. The elongated member is preferably a flexible carrier which is guided between the bore and a path between the open die halves lateral to the bore. The lateral path is perferably defined by a tubular member supported by a vertical carriage mounted on a vertical mast for alignment of the flexible carrier with the fill chamber bore when the dies are open. The vertical mast can be mounted on a horizontal carriage moveable along a horizontal bore to preclude interference with normal operation of the die-casting machine. The flexible carrier can be housed in a arcuate chamber pivoted on the side of the fixed platen and swung between the open dies to align the flexible carrier with the fill chamber bore.

34 Claims, 9 Drawing Sheets

APPARATUS AND METHOD FOR LUBRICATING AND CLEANING OUT DIE-CASTING EQUIPMENT

Cross Reference to Related Applications

This application is a continuation-in-part of U.S. patent application Ser. No. 07/754,993 filed on Sep. 6, 1991 and now U.S. Pat. No. 5,246.055 which is a continuation-in-part of PCT International Patent Application Number U.S. 90/01216 filed on Mar. 6, 1990 designating the United States, which in turn is a continuation-in-pan of U.S. patent application Ser. No. 7/320,140 filed on Mar. 7, 1989 and now U.S. Pat. No. 5,076,344.

BACKGROUND OF THE INVENTION

1. Field of the Invention

This invention relates to apparatus and a method for servicing diecasting apparatus and more particularly for lubricating and removing flash from the fill chamber or shot sleeve of die-casting apparatus from the die-end.

2. Background Information

Die-casting machines, and in particular vacuum die-casting machines, employ a piston to inject molten metal into a die cavity formed by a fixed die and a moveable die. The piston operates in a fill chamber, or shot sleeve, which extends through the fixed die member and communicates with the die cavity. The moveable die part is separated from the fixed die part to eject the cast product.

Typically, the die cavity and fill chamber are lubricated between shots. Various arrangements have been proposed for effecting this lubrication as disclosed by, for instance, in U.S. Pat. Nos. 3,209,416; 3,254,377; 3,544,355; 3,920,099; 4,223,718; 4,562,875; and 4,738,297; and Japanese patent documents 53-46779 and 62-118955.

There is a need, however, for an improved apparatus and method for lubricating the fill chamber and dies of a die casting machine, and particularly a vacuum die casting machine, which can rapidly apply a closely controlled, and variable if needed, coating of lubrication at suitable production rates. There is also a need for clearing out flashing and debris from the fill chamber between shots.

SUMMARY OF THE INVENTION

These needs and others are satisfied by the invention which is directed to apparatus and a method for die-end lubrication of the fill chamber or shot sleeve of a die-casting machine with or without associated lubrication of the die halves. It is referred to as "die-end" lubrication, because the fill chamber bore is accessed from the end nearest the die, when the die halves are open. Die-end lubrication eliminates the non-productive stroke required in some prior art lubrication processes in which a separate stroke of the piston was used for lubrication. Other important advantages of die-end lubrication are uniform, thorough applications of coatings and lubricants, the drying of the water component of water-based coatings and lubricants, and the sweeping, or evacuation of solder, or flash, from the fill chamber bore by pressurized gas blow. The lubricant is pressurized to deliver it to the fill chamber at sufficient velocity to penetrate the thermal barrier created at the surface of the hot fill chamber. In addition, the high velocity of the lubricant and the pressurized blow gas facilitate the removal of excess lubricant and flash.

More particularly, the invention embraces an apparatus and method for lubricating the fill chamber bore by insertion of an elongated member into the fill chamber bore from the die-end. This elongated member carries lubricating means for spraying the fill chamber bore with a pressurized lubricant as the elongated member is extended into the fill chamber bore and spraying the fill chamber bore with a generally conical spray of a compressed gas directed toward the die-end of the fill chamber bore as the elongated member is retracted from the fill chamber bore.

As another aspect of the invention, the apparatus comprises a flexible carder member, a servicing member carried by the flexible carder member into and out of the fill chamber bore for performing a servicing operation on the fill chamber bore, guide means for guiding the flexible carrier member between alignment with the fill chamber bore and a path generally lateral to the fill chamber bore adjacent to the die-end, and positioning means supporting the guide means and advancing and withdrawing the flexible carrier member axially along the path and into and out of the bore of the fill chamber. In a preferred embodiment of the invention, the guide means comprises a tubular member defining the path generally lateral to the fill chamber bore and into which the flexible carrier member is withdrawn, and turning means guiding the flexible member between the tubular member and the fill chamber bore. In this preferred embodiment of the invention, the positioning means includes means advancing and withdrawing the flexible carder member into the tubular member, and support means extending the guide means laterally to position the turning means adjacent the fill chamber bore, and retracting the guide means laterally clear of the die members for moving the die members to the closed position. More particularly, in this preferred embodiment of the invention the support means comprises a laterally extending mast and a first carriage moveable along the mast on which the guide means is mounted for extension and retraction. Die lubricators can be mounted on the guide means for lubricating the die halves as the guide means is carded between the die members by the first carriage. Preferably the support means includes second carriage means on which the laterally extending mast is mounted, and a base means on which the second carriage means is moveable generally transverse to the laterally extending mast to prevent interference of the lubricating apparatus with the die-casting operation.

In another embodiment of the apparatus, the guide means comprises an arcuate channel defining tile path generally transverse to the fill chamber bore. In this embodiment, the arcuate chamber is mounted, such as pivotally, adjacent the die for movement between an operative position with the arcuate channel aligned with the fill chamber bore for extension of the flexible carder member carrying the servicing member into tile fill chamber bore, and a stowed position clear of the die.

As a further aspect of the invention, the servicing member comprises a spray assembly including a spray head which generates a generally conical spray of lubricant and then of compressed gas which is directed toward the die-end of the fill chamber bore. Preferably, the spray assembly also includes a guide collar carded by the flexible carrier member adjacent the spray head and having generally helical grooves in the peripheral surface thereof which direct the generally conical spray from the spray head helically along the fill chamber bore toward the die-end while centering the spray head within the fill chamber bore. This promotes a more uniform distribution of the lubricant and compressed gas over the wall of the fiH chamber bore.

Direction of the conical spray toward the die-end promotes more efficient discharge of excess lubricant and flash from the fill chamber. In addition, it reduces the chance of lubrication entering the siphon tube through which molten metal enters the fill chamber. Furthermore, with the lubricant directed in a conical spray toward the die-end, the lubricant is not sprayed on the piston. This prevents condensation from forming on the piston when water-based lubricants are used. Elimination of this condensation produces higher quality castings with minimal gas content. The conical spray of compressed gas ejected as the spray head is retracted from the fill chamber bore dries the water-based lubricant and blows out of the fill chamber bore evaporated lubricant and solder, or flash, which has accumulated in the bore.

The invention provides the capability of customizing the pattern of application of lubrication to the fill chamber bore. This is accomplished by dividing the bore into lubrication zones and adjusting the quantity of lubrication applied to the respective zones. More particularly, the number of lubrication zones and the individual length of each zone are selectable as is the portion of the total quantity of lubrication to be applied in each zone. Preferably, the lubrication is discharged from the spray head at a fixed discharge rate, and the velocity of the spray head as it moves through the fill chamber bore is adjusted to apply the selected quantity of lubricant to each lubrication zone. This flexible application of lubrication accommodates for wear in the fill chamber bore, especially where the wear is not uniform along the bore.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
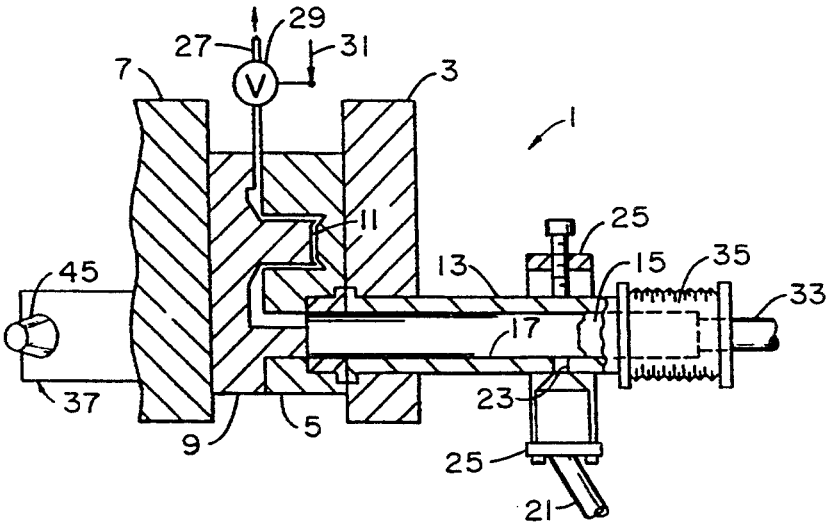
FIG. 1 is a schematic cross-section through a vacuum die-casting machine incorporating a first embodiment of the invention.

FIG. 1 shows a cold chamber, horizontal, self-loading, vacuum diecasting machine 1 to which a first embodiment of the invention has been applied. This vacuum die-casting machine 1 has a fixed clamping plate 3, or platen, with a fixed die, or mold half 5, and a moveable clamping plate 7, or platen, with a moveable die, or mold half 9. The fixed die half 5 and moveable die half 9 form a die cavity 11 in the closed position as shown in FIG. 1. Molten metal is injected into the die cavity 11 from a fill chamber 13 by a piston 15 which slides within the bore 17 of the fill chamber 13. Molten metal is supplied to the fill chamber 13 from a holding furnace 19 through a suction or fill tube 21. The suction tube 21 is connected to an inlet orifice 23 in the fill chamber 13 by a clamp 25. Air and other gases are removed from the die cavity 11 and the fill chamber bore 17, and molten metal is sucked from the holding furnace 19 through the suction tube 21 into the fill chamber bore 17 by application of vacuum to vacuum line 27 which is connected to the die cavity 11 in the area which is last filled by incoming molten metal. Vacuum line 27 is opened and closed by a valve 29 which may be operated by a control line 31 by control equipment (not shown).

The molten metal drawn into the fill chamber 13 is charged into the die cavity 11 by the piston 15 through piston rod 33 by a prime mover (not shown). The rear end of the fill chamber 13 is sealed to the piston rod 33 by a sealing device 35 described in the cross-referenced applications.

Figure 2:
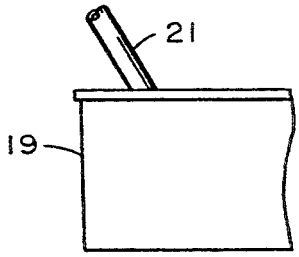
FIG. 2 is a schematic cross-sectional plan view of the die-casting machine of FIG. 1 shown with the die halves in the open position and illustrating the stowed position of the die-end lubricator in full line, and the operational position of the die-end lubricator in phantom line.
Figure 2:
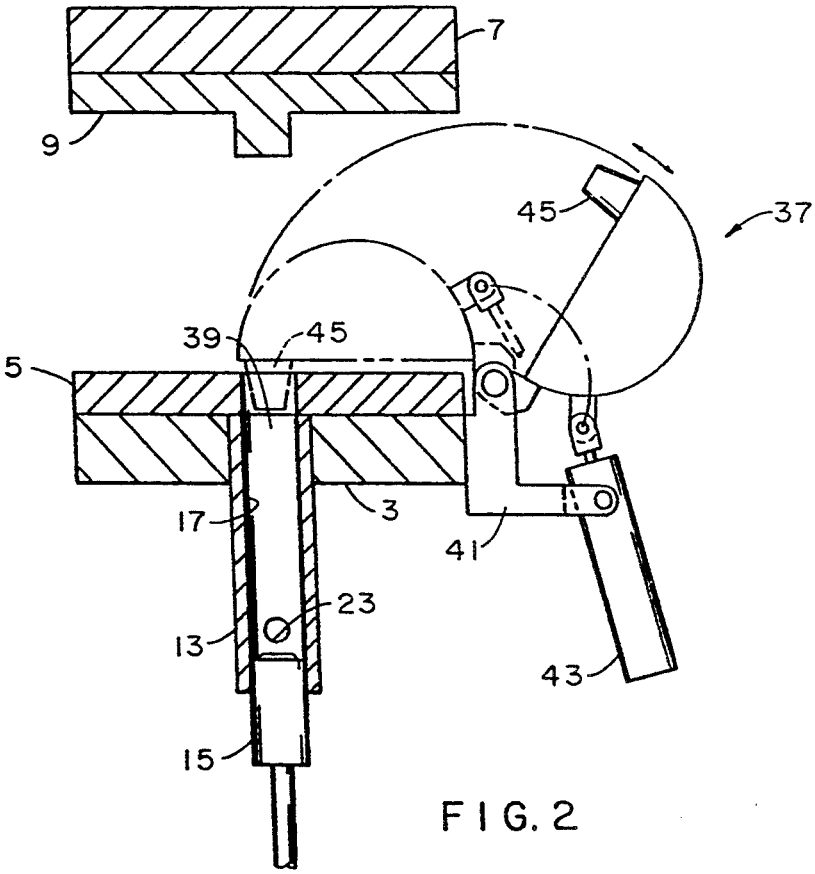

A die-end lubricator 37 in accordance with the invention is used to apply lubricant to, and to remove flashing and other debris from, the bore 17 of the fill chamber 13 from the die-end 39 when the moveable die half 9, the moveable platen 7, plus an ejector die (not shown) have separated from the fixed die half 5 and fixed platen 3 as shown in FIG. 2. The die-end lubricator 37 is pivotally attached by a bracket 41 to the fixed platen 3 and can be rotated by an hydraulic or pneumatic cylinder 43 between the stowed position shown in fill line in FIG. 2, where it is clear of the moveable die half 9 and moveable platen 7, and an operative position shown by the phantom lines in FIG. 2 when the die halves have been opened. In the operative position, a spray assembly 45 is aligned for insertion into the fill chamber bore 17 to execute its applicator, drying, and sweeping functions.

Figure 3:
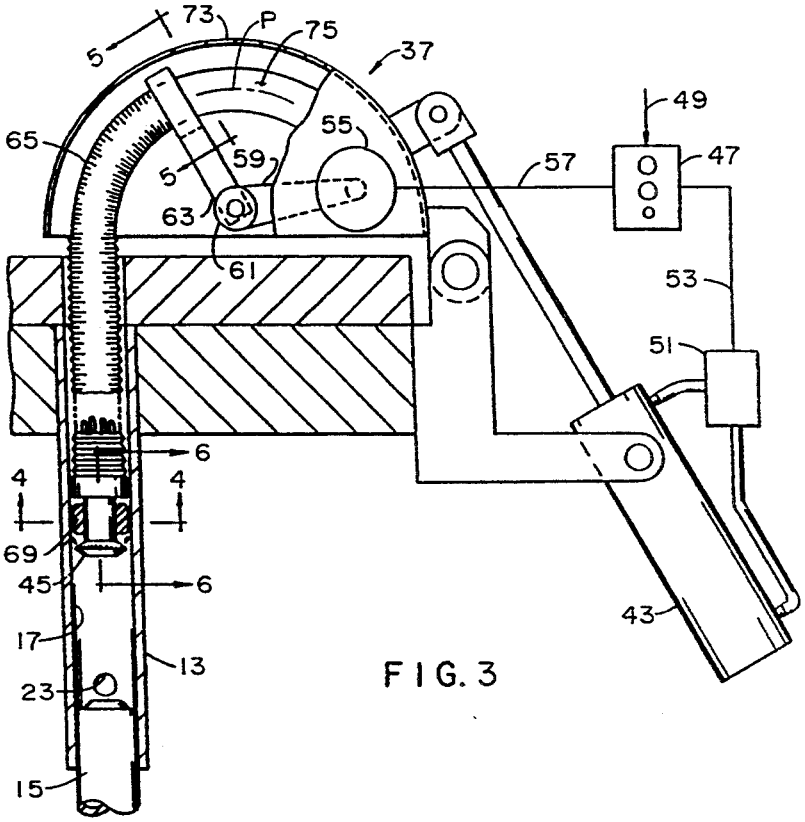
FIG. 3 is a view similar to FIG. 2 showing extension of the lubricator into the fill chamber of the die-casting machine.

FIG. 3 shows the die-end lubricator in greater detail. A programmable controller 47 receives information from the die-casting machine 1 via line 49 that the machine is in the appropriate state (i.e., the die-halves are open and the last casting has been ejected) and commands a fluid pressure unit 51 over lead 53 to cause the hydraulic cylinder 43 to move the die-end lubricator 37 into the operative position.

The programmable controller 47 also operates a servo-motor 55 through line 57 to drive a tinting belt 59 thereby turning a pulley 61 and arm 63 rigidly connected to the pulley, to extend a flexible carrier in the form of flexible tubing 65 which carries the spray assembly 45 into the fill chamber bore 17. The flexible tubing 65 houses four tubes **67*a*–67*d* connected to the spray assembly 45 for reasons to be explained. (See FIGS. 5 and 6**).

Figure 4:
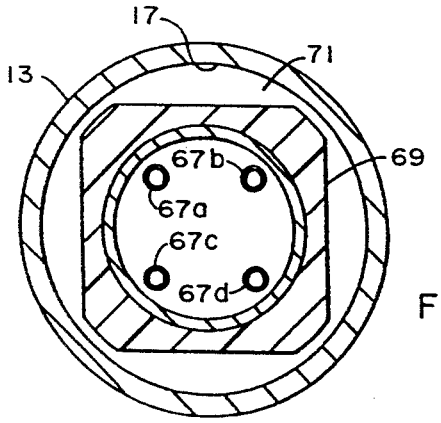
FIG. 4 is a cross-sectional view taken along the line 4—4 in FIG. 3.

The spray assembly 45 includes a polytetrafluoroethylene (PTFE) collar 69 to guide the spray assembly 45 in the fill chamber bore 17. The collar 69 has a generally polygonal cross-section, for example the square cross-section with the corners rounded as shown in FIG. 4, so that it only contacts the bore 17 at the rounded corners, thus leaving gaps 71 for purposes which will become apparent from what follows.

Figure 5:
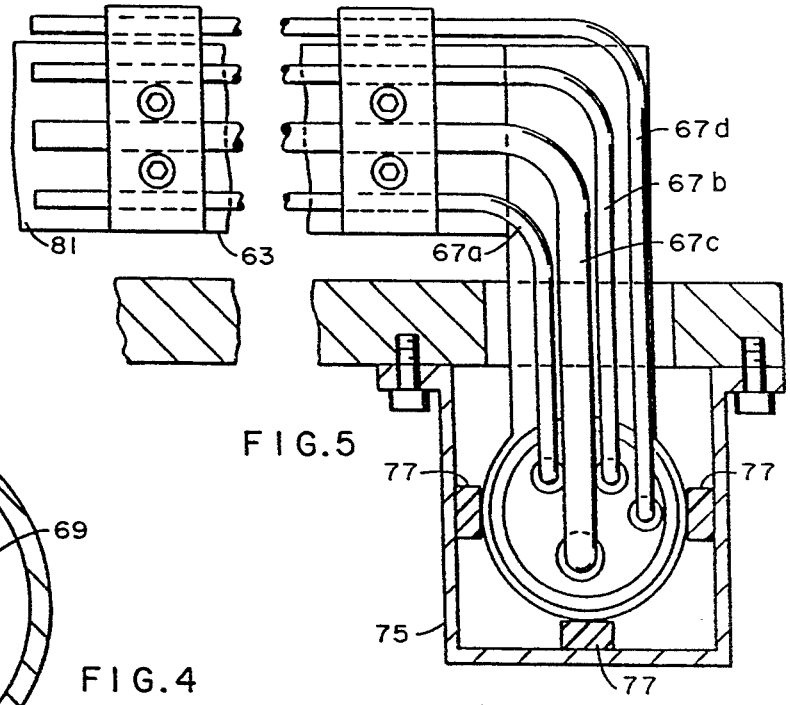
FIG. 5 is a sectional view taken along the line 5—5 in FIG. 3.

FIG. 3 shows that the flexible tubing or carrier 65 is constrained to move in an arcuate path P within a housing 73 of the lubricator 37 by an arcuate channel 75. This arcuate path may be circular as shown in FIG. 2. This flexible conduit or carrier 65 is guided within the channel 75 by angularly displaced PTFE tracks 77 (see FIG. 5) as it is driven by ann 63. FIG. 5 also shows the four tubes **67*a*–67*d*. Tubes 67*a* and 67*b* are feed and return lines for the lubricant or coating supplied to the spray assembly 45. Preferably a water-based lubricant such as that described in the cross-referenced applications is used. Tube 67*c* is the air supply for the spray assembly 45, and tube 67*d* is a pneumatic power supply line for a valve 79 (see FIG. 6) in the spray assembly 45. The tubes 67*a*–67*d* extend between the spray assembly 45, through the flexible tubing 65, and along the ann 63 to the point 81** where they are connected to flexible tubing extending to air and lubricant supply vessels (not shown).

Figure 6:
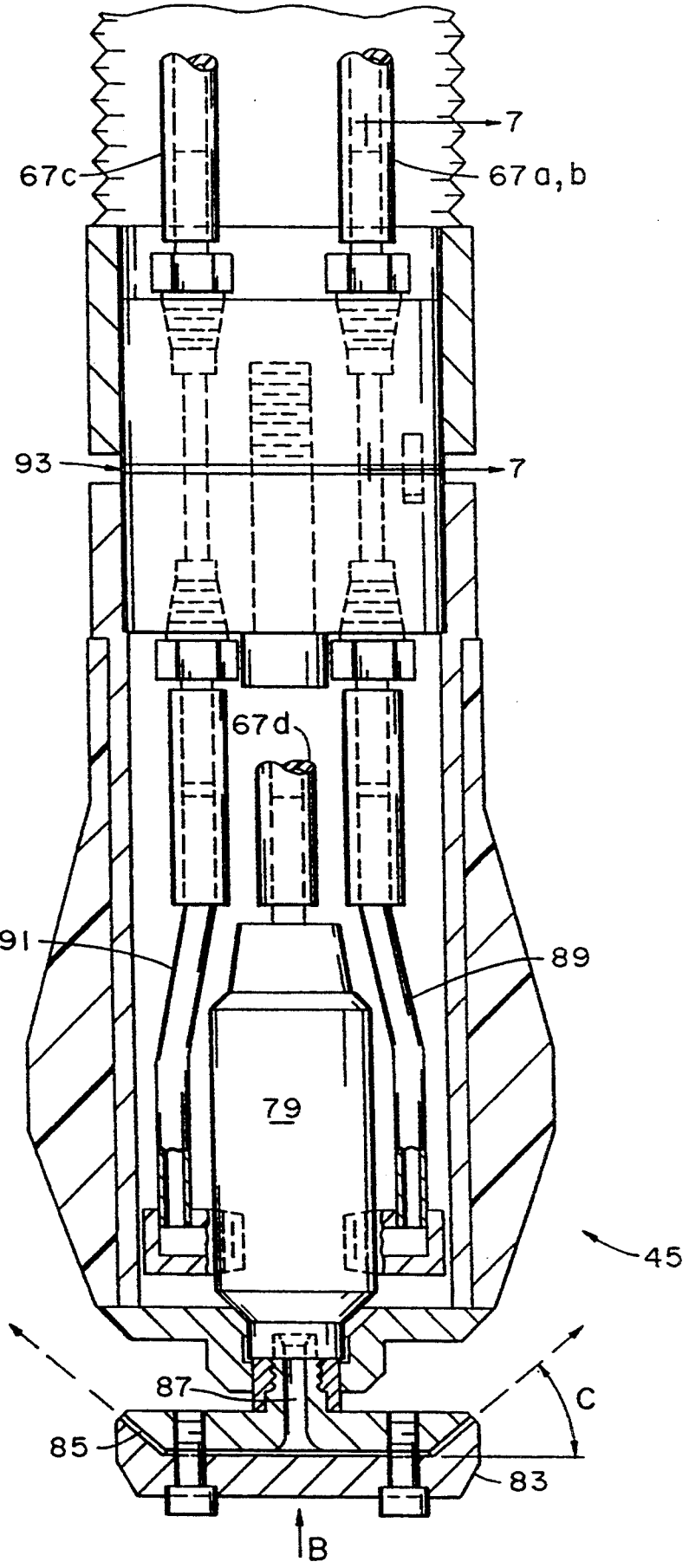
FIG. 6 is a longitudinal sectional view taken through a portion of the spray head and flexible carrier of the die-end lubricator shown in FIG. 3 and taken along the line 6—6.

FIG. 6 shows greater detail for the spray assembly 45 of the die-end lubricator 37. The spray assembly 45 includes the spray head 83, which is circular when viewed in the direction of arrow B. The spray head 83 has a sufficient number of spray orifices 85 distributed around the circumference that it provides an essentially continuous conical sheet of backwardly directed spray, that is the spray generated within the bore 17 is directed toward the die-end 39 of the fill chamber bore 17. An example for a spray head 83 having a diameter of 2.25 inches is 18 evenly spaced orifices 85 each having a bore diameter of 0.024 inches. The angle C is preferably about 40°. Angles in the range of about 30° to 50°, preferably in the range 35° to 45°, may serve for purposes of the invention.

A nozzle mixing chamber 87 receives the lubricant or coating from a tube 89 connected to the hoses **67*a* and 67*b* and air from a tube 91 connected to hose 67*c*, or just air from tube 91, depending upon whether valve 79 has opened or closed tube 89 as directed by pneumatic line 67*d***.

Figure 7:
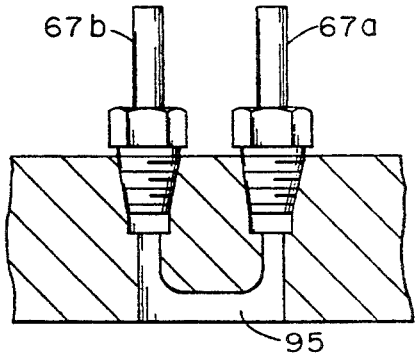
FIG. 7 is a partial sectional view taken along the line 7—7 in FIG. 6.

The spray assembly 45 is connected to the flexible tubing or carder 65 at junction 93. Line **67*c* extends straight through the junction to tube 91. Hoses 67*a* and 67*b* are short-circuited at the junction, to provide for a continual recirculation of the lubricant or coating, this being helpful for preventing settling of suspensions or emulsions. The short-circuit passage 95 is shown in FIG. 7. Tube 89 is continually open to the short-circuit, but only draws from that point when directed by valve 79, at which tinge programmable controller 47 causes a solenoid valve (not shown) in the return hose 67*b* to close, in order to achieve maximum feed of lubricant or coating to the spray head 83**.

Programmable controller 47 shown in FIG. 3 controls the pneumatic pressure supply for fine **67*c* to direct air to open valve 79, such that a lubricant or coating aerosol is sprayed onto the fill chamber bore 17 as the spray head moves toward the retracted piston 15. The programmable controller 47 does not operate the servo motor 55 to drive the spray head 83 so far that it would spray lubricant down the inlet orifice 23. The spray head 83 is stopped short of that point, but sufficient aerosol is expressed in the region that part of the bore at the inlet orifice does get adequately coated. The programmable controller 47 additionally provides the ability to vary spray head speed along the bore 17**, in order to provide trouble points with more coating should such be desired.

Once the spray head 83 has gone as far as it should go, just short of the inlet orifice 23, it is retracted by operation of the servo motor 55 which rotates the arm 63 to pull the flexible tubing or carrier 65 back into the arcuate channel 75. During retraction, the programmable controller 47 causes the pneumatic valve 79 to turn the lubricant or coating supply off, so that only air from the hose **67*c* and tube 91 exits through the spray orifices 85. This conical spray of air directed toward the die-end 39 of the bore 17 dries water from water-based lubricant or coating on the bore 17, and sweeps it, in gasified form, together with loose solder, or flash, from the bore 17. The gaps 71 between the collar 69 and the fill chamber bore 17 provide space through which the gas flow out of the spray head 83 can escape at the die-end 39 of the fill chamber bore 17. When the spray assembly 45 is back in its retracted position, as shown by the phantom lines in FIG. 2, programmable controller 47 operates cylinder 43 to swing the lubricator 37** back out of the path of the movable die half, the die halves are closed, and the die-casting machine is ready to make the next casting.

Figure 8:
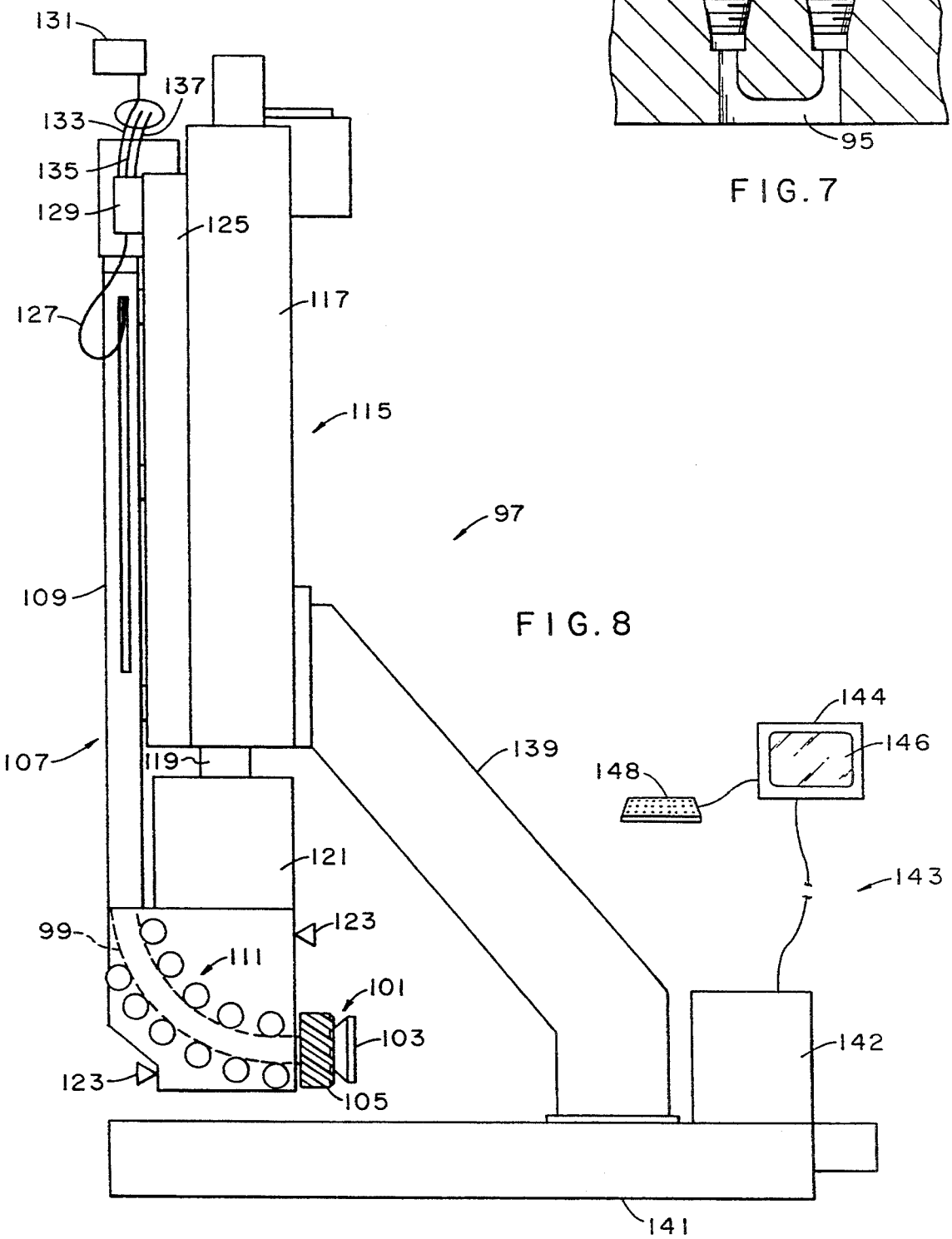
FIG. 8 is a side view of a second embodiment of a die-end lubricator in accordance with the invention.

FIGS. 8–12 illustrate a second, preferred embodiment of the invention. As shown in FIG. 8, this embodiment of the die-end lubricator 97 includes a flexible carrier 99 which supports at its free end a spray assembly 101 which includes a spray head 103 and a guide collar 105. The flexible carrier 99 is guided by a guide structure 107 which includes a tubular member 109 defining a path lateral to the fill chamber bore and a set of turning rolls 111 which guide the flexible member 99 through a substantially 90° turn from the path defined by the tubular member 109.

The guide structure 107 is supported by a positioning device 115. This positioning device 115 includes a vertical mast 117 and a vertical carriage 119 which is raised and lowered on the mast 117. The guide structure 107 is mounted on and raised and lowered by the vertical carriage 119. The vertical carriage 119 also supports at its lower end a die lubricator 121 which carries a matrix of die spray nozzles 123 (only two shown) on front and back surfaces for spraying the dies with lubrication in a manner which will be discussed.

A linear drive 125 also mounted on the verticle carriage 119 extends and retracts the flexible carrier 99 from the tubular member 109 through the set of turning rolls 111 and into and out of the fill chamber bore in a manner to be discussed below. A single hose 127 extends from an atomizer 129 through the flexible carder 99 to deliver lubricant and/or compressed air to the spray head 103. A measured supply of lubricant is delivered from a lubricant supply, shown schematically at 131, through a hose 133 to the atomizer 129. Compressed air for delivery to the spray head 103 is delivered to the atomizer through hose 135, while control air is supplied through the hose 137.

The vertical mast 117 is supported by a horizontal carriage 139 for horizontal movement on a base 141. Movement of the vertical and horizontal carriages 119, 139, operation of the linear drive 125 (which extends and retracts the flexible carder 99), and operation of the atomizer 129 are all controlled by a computer based control system 143. This system includes a control unit 142 which is controlled by a remotely located computer 144 having a display 146 and an input device, such as, for example, a key board 148.

Figure 9:
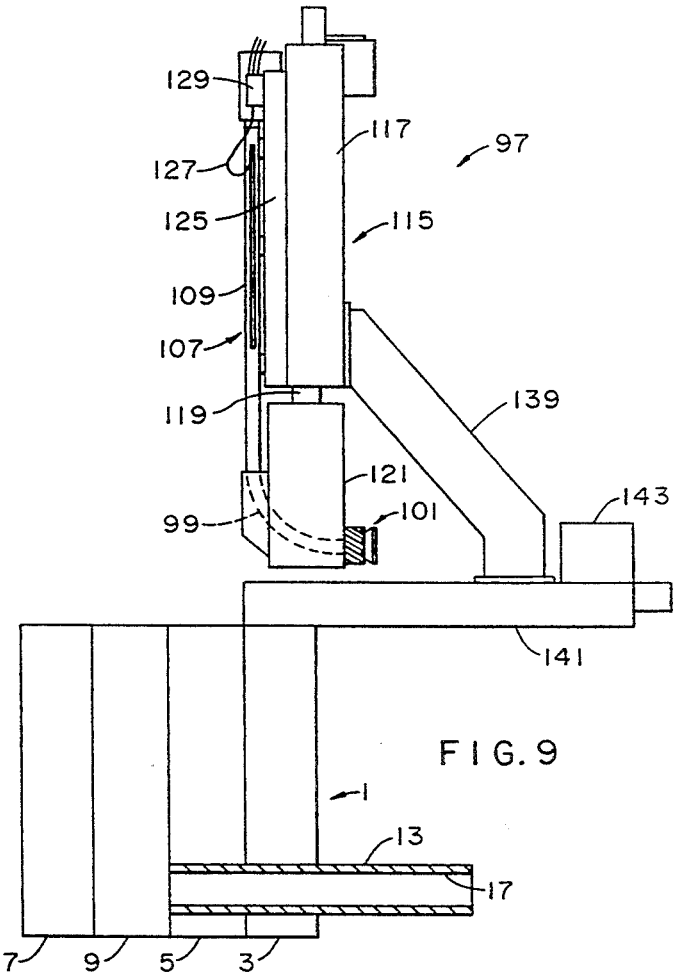
FIG. 9 is a schematic view, partially in section, showing the die-end lubricator of FIG. 8 in the stowed position with respect to a vacuum die-casting machine.
Figure 10:
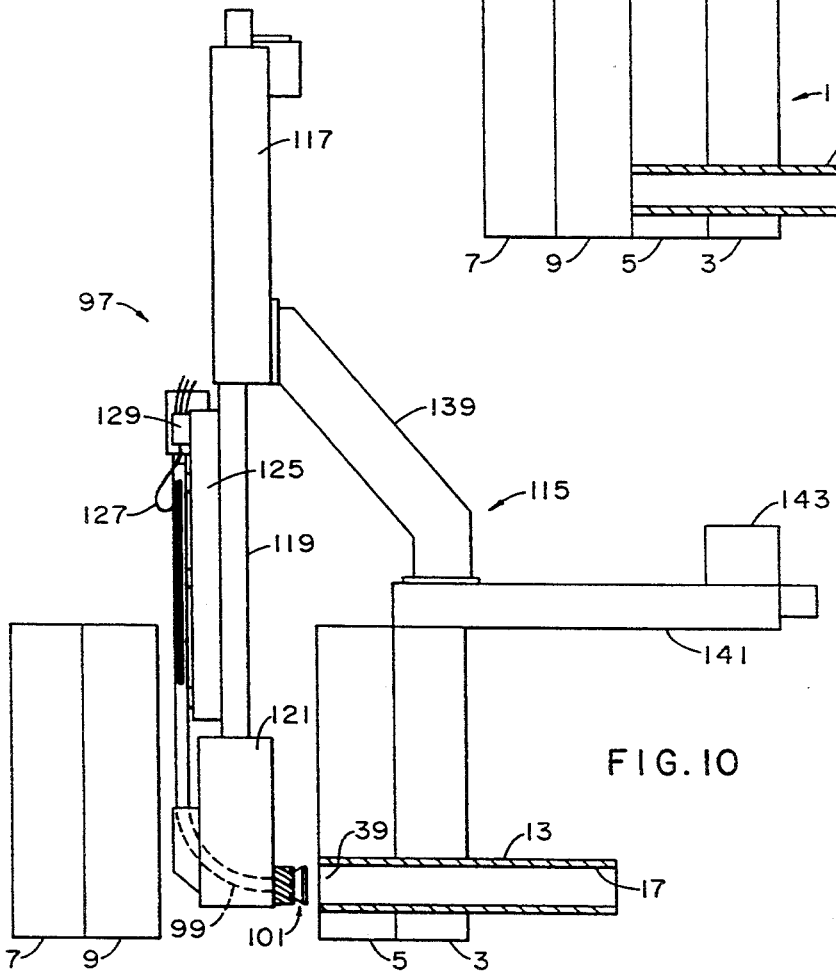
FIG. 10 is a view similar to FIG. 9 showing the die-end lubricator aligned with the fill chamber in the die-casting machine with the dies in the open position.

When not in use, the die-end lubricator 97 is stowed in the position shown in FIG. 9 where it does not interfere with normal operation of the vacuum die casting machine 1. When the die has been opened and the casting removed so that the machine 1 is ready for lubrication prior to the next casting operation, the control system 143 is operated to move the horizontal carriage 139 along the base 141 to align the vertical mast with the opening between the fixed die half 5 and the moveable die half 9. The vertical carriage 119 is then operated to lower the guide structure 107 to align the spray head 103 with the fill chamber bore 17 as shown in FIG. 10. As the vertical carriage is lowered, the matrix of die spray nozzles 123 is activated to spray the fixed die half 5 and the moveable die haft 9 with a suitable lubricant-/coating.

Figure 11:
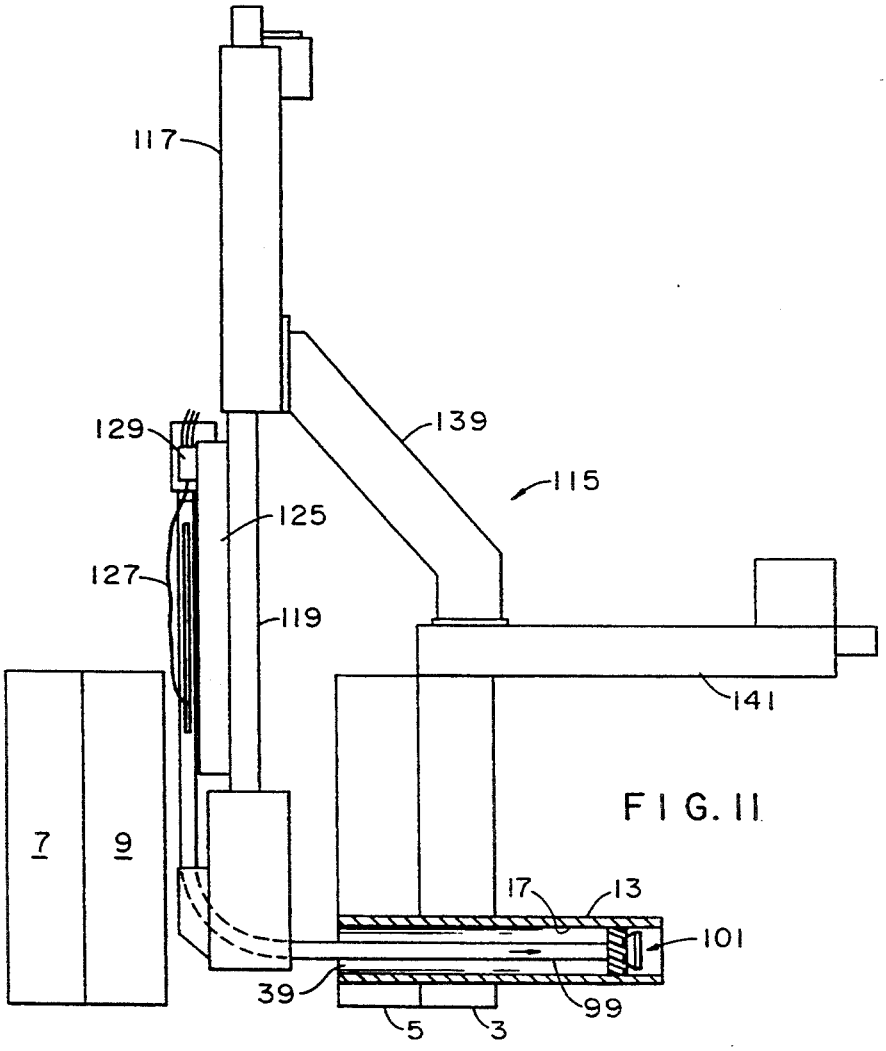
FIG. 11 is a view similar to FIG. 10 showing the spray head of the die-end lubricator inserted into the fill chamber bore.
Figure 12:
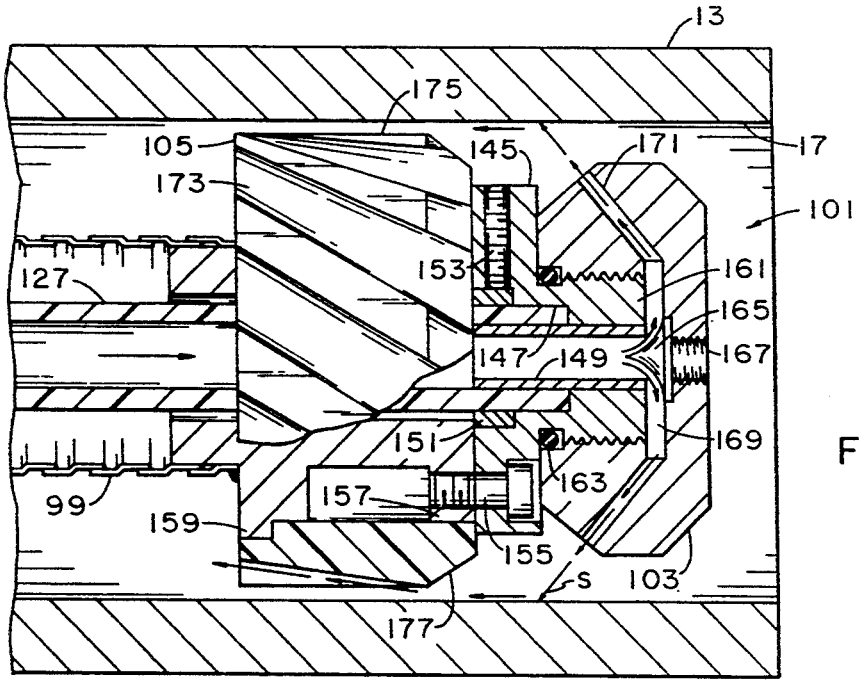
FIG. 12 is an enlarged longitudinal section through the spray head and guide which form part of the die-end lubricator shown in FIGS. 8 through 11.

With the spray assembly 101 aligned with the bore 17 of the fill chamber, the linear drive 125 is activated to extend the flexible carrier 99 carrying the spray assembly 101 into the bore 17 as shown in FIG. 11. FIG. 12 illustrates the spray assembly 101 as it is positioned in the fall chamber bore 17. The spray assembly 101 includes a mounting ring 145 having a counter bore 147 with three sections of increasing diameter. A rigid tubular insert 149 is seated in the smallest diameter of the counter bore 147 and fits snugly inside the hose 127. The hose 127 seats in the next larger diameter of the counter bore and is secured in place by a split clamp ring 15 1 which seats in the largest diameter of the counter bore 147 and is pressed against the hose 127 by three angularly spaced set screws 153 (only one shown). Three similarly angularly spaced socket head screws 155 (again, only one shown) extend axially to secure the mounting ring 145 to a flange 157 on the end of the flexible carrier member 99. The guide collar 105 is secured to the end of the flexible member 99 between a flange 159 and the mounting ring 145.

The spray head 103 is threaded onto a boss 161 on the mounting ring 145. An O-ring 163 provides a seal and prevents the spray head from backing off due to vibration. A splitter 165 screwed into a tapped counter bore 167 inside the spray head distributes fluid supplied through the hose 127 radially outward into a circular chamber 169 for delivery to a number of spray orifices 171, (for example, 18 in the exemplary spray head), angularly spaced around the spray head. As discussed previously, these spray orifices 171 direct a spray radially outward and axially to create a conical spray "S" directed toward the die-end 39 of the fill chamber bore 17.

The guide collar 105 has a number of helical groves 173 in a peripheral surface 175. These helical groves twist the conical spray "S" so that with movement of the spray assembly 101 through the bore 17, the entire wall surface of the bore is sprayed. The collar 105 also serves as a guide which centers the spray head 103 within the bore 17. The leading edge of the guide collar 105 is beveled at 177 to assist in lead-in of the spray assembly 101 into the fill chamber bore 17.

In this second embodiment of the invention, the atomizer 129 is located remotely from the spray head 103. (See FIGS. 8–11). A single hose 127 extends from the atomizer 129 through the flexible carrier 99 to the spray head 103. This single hose design reduces blockage and allows for higher pressure application of lubricant and air to the fill chamber. There is no on-off control at the spray head, and therefore a valve and control therefor at the spray head are not required.

Figure 13:
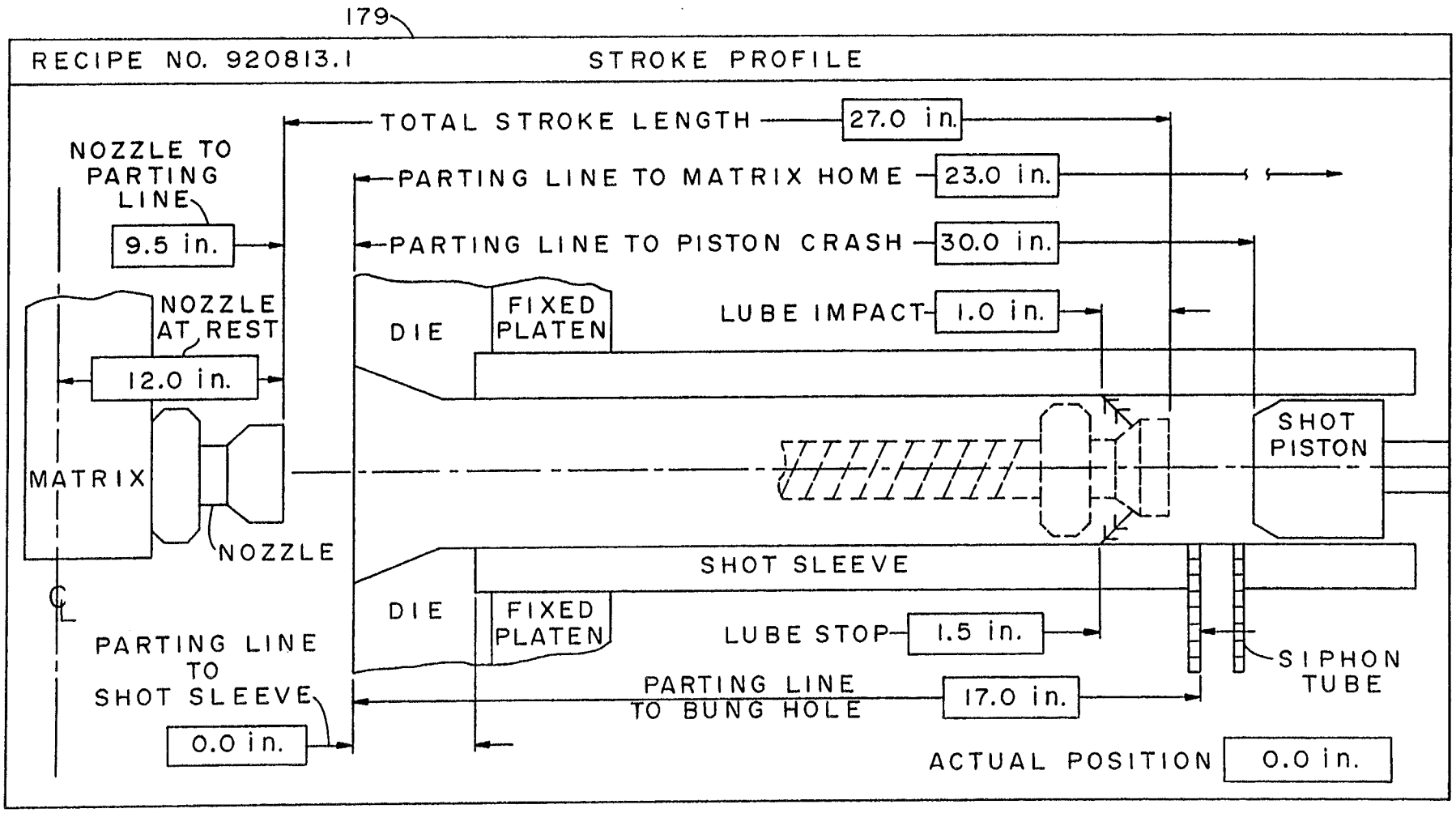
FIG. 13 is an illustration of a computer screen generated by the dieend lubricator shown in FIGS. 8–12.
Figure 14:
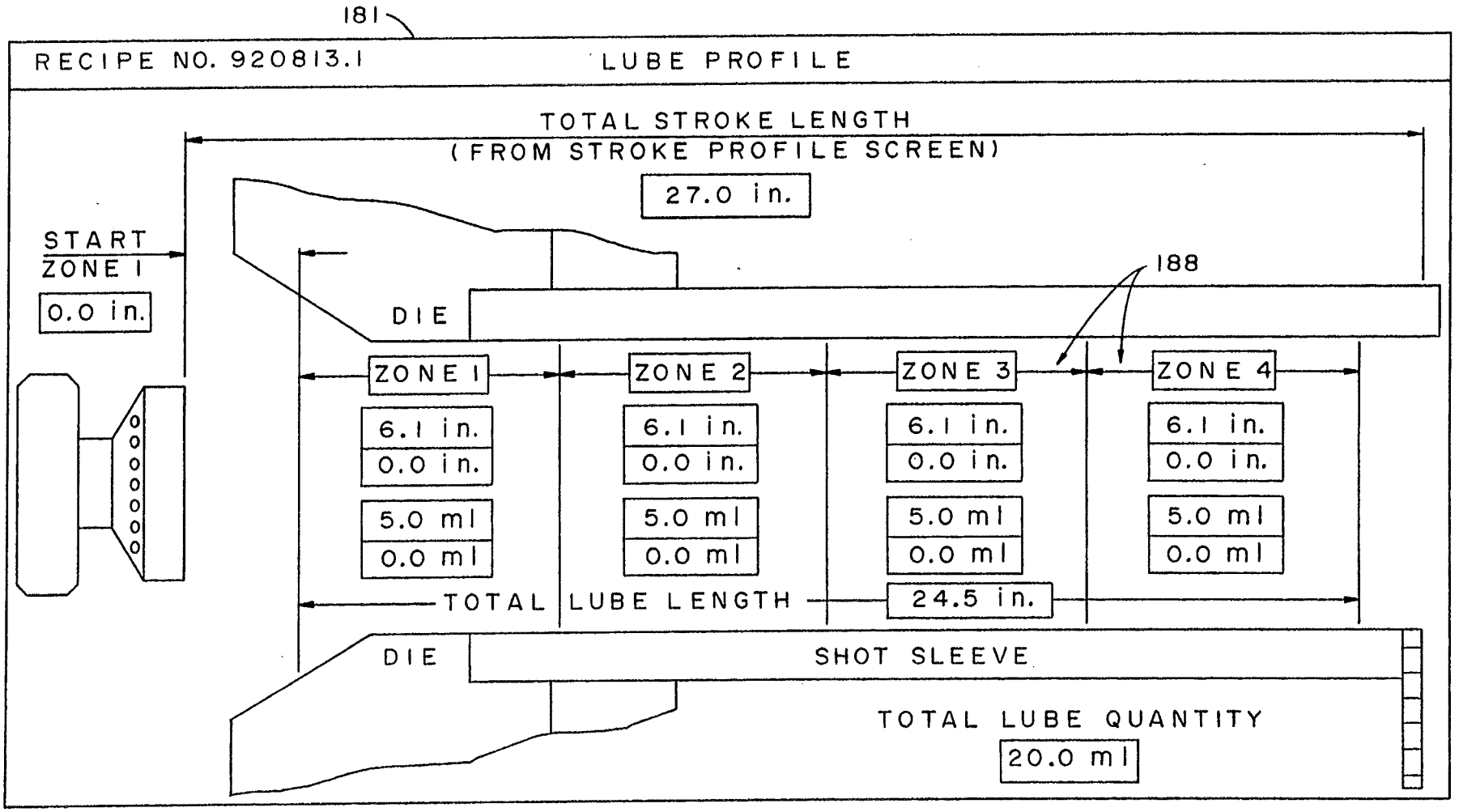
FIG. 14 is an illustration of another computer screen generated by the die-end lubricator shown in FIGS. 8–12.

The computer-based control system 143 is in communication with the die caster control unit 142 described above. As the vacuum die casting machine 1 completes a die casting cycle and the movable die half 9 and movable platen 7 separate from the fixed die half 5 and fixed platen 3, as shown in FIG. 2, the die caster control unit provides a triggering signal to the die-end lubricator computer based control system 143. The control system 143 then initiates the lubrication cycle. The computer-based control system 143 includes a Programmable Logic Computer (PLC) and a Man-Machine Interface (MMI). Through the MMI display screens 179, 181 as shown in FIGS. 13 and 14, respectively, the operator is able to modify the operating parameters of the lubrication cycle. For example, the operator can adjust the length of the stroke of the lubricator servicing member, set the end location of the stroke and thus the position of the spray head 103 relative to the siphon 23, and establish the amount of lubrication fluid to be sprayed into the bore 17 of the fill chamber during the lubrication cycle. Additional adjustments available to the operator will become evident through the discussion to follow.

A critical factor in the lubrication of the shot sleeve is the determination of the quantity of lubrication to be used. For example, insufficient lubrication will result in premature failure of the shot sleeve. On the other hand, excess lubricant will contaminate the die cast product and result in unnecessary lubricant waste.

Figure 15:
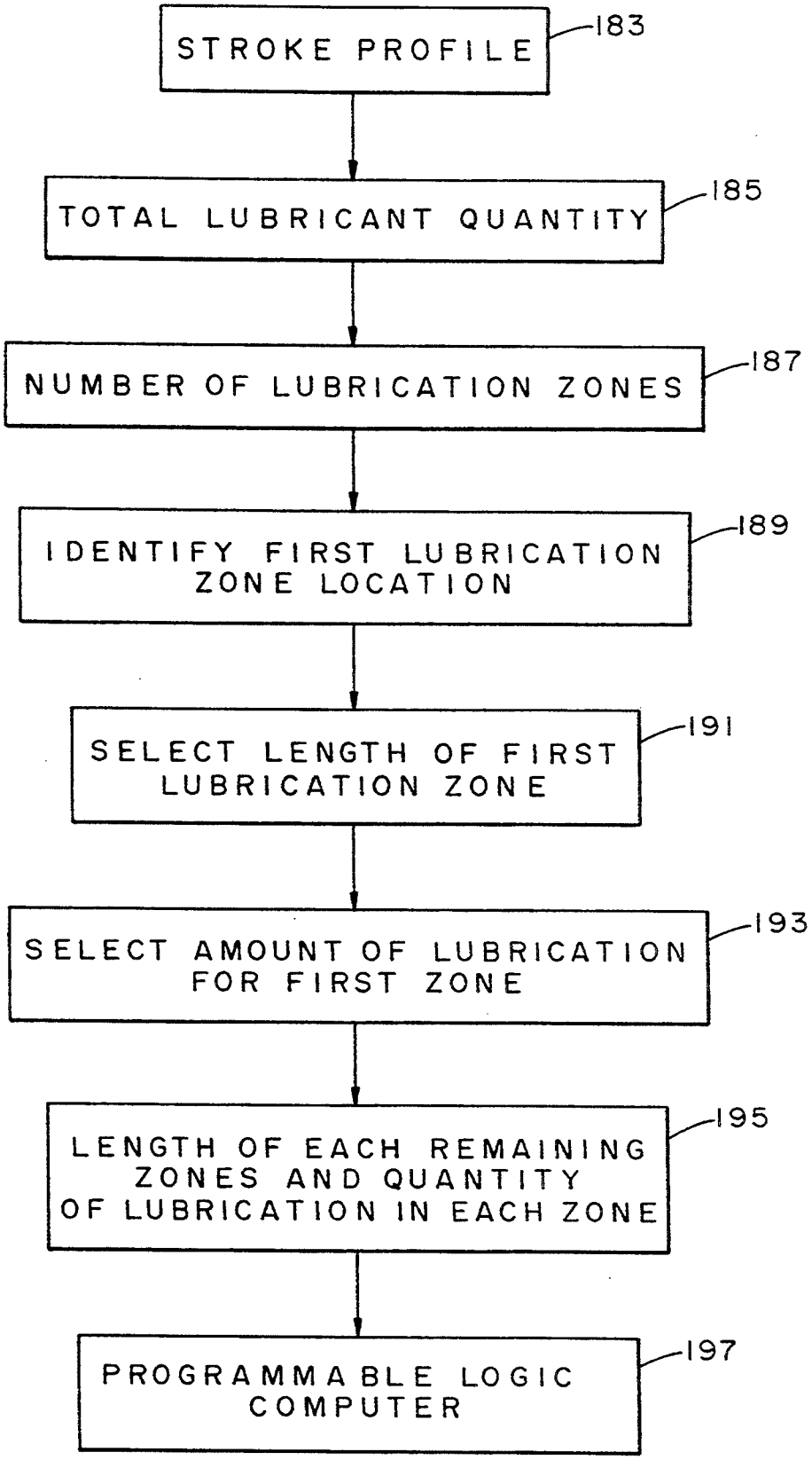
FIG. 15 is a flow chart for a suitable computer program controlling the operation of the die-end lubricator of FIGS. 8–12.

The process by which an operator establishes the parameters of the lubrication cycle through the MMI and the method by which the computer control system directs the advancement of the servicing member through the bore 17 can be appreciated through the consideration of FIGS. 13, 14, and 15 in conjunction with the following description.

Referring to FIG. 15, the first step 183 in programming the computer-based control system 143 for the lubrication system is determining the stroke profile of the lubrication nozzle or spray head 103. The stroke profile screen 179 generated in the MMI is illustrated in FIG. 13. Through the use of an input device such as a key board 148, the operator can customize the stroke for a particular operation. The stroke profile includes the distance between the nozzle's at rest position during the actual vacuum die casting operation and the end of travel point, just short of the siphon tube 21. Additionally, the operator must determine the distance from the at rest condition of the nozzle to the die parting line. A further measurement that must be established is the distance from the parting line to the shot sleeve 17. These measurements are critical so that lubrication of the shot sleeve does not begin until the nozzle is properly located within the die cast machine and lubrication terminates prior to the nozzle 103 reaching the siphon tube 21. During the lubrication process, the actual position of the nozzle or spray head 103 measured from the at rest position of the spray head outside the fill chamber is presented numerically in the lower right hand comer of the screen. The particular configuration of the stroke profile as established by the operator is identified as a "Recipe#" in the upper left hand comer of the screen and can be stored for later retrieval and reuse. The numerical screen entries shown in FIG. 13 are exemplary only.

Returning to FIG. 15, the second step 185 in the program requires the operator to identify the total quantity of lubricant to be used during the shot sleeve lubrication process. As mentioned above, the quantity of lubrication selected is a function of a variety of considerations all of which require operator analysis and input.

FIG. 14 provides an example of the lube profile screen 181. Again, the numerical entries are exemplary only. The total quantity of lubricant for the lubrication process is displayed in the lower right hand comer of the screen. The lubrication is discharged from the spray head 103 at a fixed rate. The variability in the application of the lubricant in the respective zones is obtained by adjusting the speed at which the spray head is advanced through the fill chamber bore 17. Thus, with the discharge rate at which lubricant is discharged from the nozzle held constant, the application rate at which lubricant is applied to the fill chamber bore is adjusted by adjusting the velocity at which the nozzle is advanced through the fill chamber bore.

In the third step 187 shown in FIG. 15, the operator selects the number of lubrication zones 188 to be identified within the shot sleeve 13. Each lubrication zone 188 constitutes a discrete, predetermined distance of servicing member travel or bore length within the fill chamber bore 17. A predetermined quantity of lubricant is discharged from the nozzle or spray head 103 onto the bore surface in each lubrication zone. At least two such zones can be employed. According to a preferred embodiment, four separate lubrication zones are established. However, it should be appreciated that the number of zones employed is a function of the total length of the shot sleeve. By way of example, it has been found that in a shot sleeve of 24 inches in length, the use of four zones provides excellent control and lubrication characteristics throughout the length of the shot sleeve.

As a forth step 189, the operator establishes the distance from the at-rest position of the nozzle to the beginning of lubrication zone 1. Typically it can be expected that the beginning of lubrication zone 1 will coincide with the junction of the shot sleeve 13 and the die 5.

Having identified the beginning of lubrication zone 1, the fifth step 191, requires the operator to identify the length of zone 1. Should the operator so desire, the computer-based control system 143 assumes four zones of uniform length and defaults to this assumption. The operator is permitted to identify and enter into the system the length of zone 1 in view of the requirements of the casting operation.

In the sixth step 193 of this process, the operator identifies the quantity of the lubricant to be applied in the shot sleeve 17 as the nozzle advances through the first zone. This quantity is a value that is established as a percentage of the total quantity of lubricant. The total quantity of lubricant to be applied during the complete lubrication process was established in the second step 185.

In the step seven 195, the operator identifies both the length of the remaining zones and the quantity of lubricant to be applied in each of the now dimensionally defined remaining zones. At a minimum, two zones are defined. Preferably as discussed above, four zones are established. As a default in the preferred system, the computer-base control system 143 assumes an equal distribution of lubricant throughout the shot sleeve in any zones not defined by the operator. For example, if the operator determines that 50% of the total lubricant is to be applied to the first of four zones, the control system will apply equally the remaining 50% of the lubricant in the remaining three zones. If the first zone is established as comprising nine 9 inches in a bore 24 inches in length, the remaining zones will each be 5 inches in length. The remaining 50% of the lubricant will be applied equally along the last 15 inches of the final three zones of the bore. In the event that a complete operator default condition exists in steps five, 191; six, 193; and seven, 195; the computer based control system 143 automatically programs the lubrication system for the uniform application of lubrication throughout the shot sleeve. This information concludes the setup of the computer-based control system for its operation of the lubrication system. The Man-Machine Interface is configured to provide predetermined limits that control and monitor operator setup. Predetermined limits substantially eliminate the possibility of inadvertent damage to either the vacuum die casting machine or the vacuum die cast product that could result from an operator error such as poorly defined lubrication process in which a minimum necessary quantity of lubricant is not applied or a maximum quantity of lubricant exceeded.

Once the lubrication parameters are set up in the above manner, the computer based control system 143 executes programmable logic 197 which effects lubrication and blow-out of the fill chamber 13. The process includes positioning the die-end lubricator 97 to align the spray assembly 101 with the fill chamber bore 17 and operating the linear drive 125 to extend the flexible carrier and insert the spray head 103 into the bore 17 at a controlled rate. The number of zones 188 into which a lubrication process can be divided is to some extent limited by the rates of acceleration and deceleration of the servo-control system driving the lubrication nozzle or spray head. For example, a 24-inch shot sleeve with 4 zones of 6 inches each is traversed in less than one second by the lubrication nozzle. The typical maximum nozzle velocity is 30 inches per second. Additionally, the velocity of the nozzle is also limited by the maximum amount of lubrication that the nozzle can discharge into the shot sleeve. The lubrication is discharged from the spray head at a fixed discharge rate. The variability in the quantity of lubricant applied in the respective zones is obtained by the adjustment of the speed at which the spray head is advanced through the fill chamber bore. The speed of advance is automatically calculated by the control system 143 according to the dimension of the selected zone and desired quantity of lubricant to be applied to the selected zone.

During the withdrawal of the lubrication spray nozzle from the fill chamber bore, the nozzle sprays the walls of the shot sleeve with a spray of compressed gas. It is found to be sufficient in cleaning and spraying the bore during withdrawal to maintain the nozzle at a constant velocity.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the appended claims and any and all equivalents thereof.

What is claimed is:

1. Apparatus for performing a servicing operation within a die-casting machine fill chamber bore opening at a die-end into a die, said apparatus comprising: a flexible carrier member extendable into and retractable from said fill chamber bore through said die-end, a servicing member carried by said flexible carrier member into and out of said fill chamber bore and which performs said servicing operation on said fill chamber bore while within said bore, guide means for guiding said flexible carrier member between alignment with said fill chamber bore and a path generally lateral to the fill chamber bore adjacent said die-end, and positioning means supporting said guide means and advancing and withdrawing said flexible carrier member axially along said path and into and out of the bore of said fill chamber.

2. The apparatus of claim 1 wherein said servicing member comprises a spray assembly including a spray head generating a generally conical spray extending outwardly toward said die-end of said fill chamber bore.

3. The apparatus of claim 2 wherein said spray assembly further comprises a collar on said flexible carrier member adjacent said spray head and having generally helical grooves in a peripheral surface thereof for directing said generally conical spray from said spray head helically along said fill chamber bore toward said die-end of said fill chamber bore.

4. The apparatus of claim 2 wherein said flexible carrier member includes a single conduit extending therethrough to said spray head and a mixing chamber connected to said single conduit to selectively deliver lubricant, compressed gas or mixtures thereof through said single conduit to said spray head.

5. The apparatus of claim 1 wherein said die comprises a fixed die member and a moveable die member moveable between a closed position and a spaced apart open position and wherein said guide means comprises a tubular member defining said path generally lateral to the fill chamber bore and into which said flexible carrier member is withdrawn, and turning means guiding said flexible member between said tubular member and said fill chamber bore, and wherein said positioning means includes means advancing and withdrawing said flexible carrier member in said tubular member, and support means extending said guide means laterally with said die members in the spaced part open position to position said turning means adjacent said fill chamber bore and retracting said guide means laterally clear of said die members for moving said die members to the closed position.

6. The apparatus of claim 5 wherein said support means comprises a laterally extending mast and a first carriage moveable along said mast and on which said guide means is mounted for extension and retraction.

7. The apparatus of claim 6 wherein said guide means includes die lubricators for lubricating said fixed die member and said moveable die member as said guide means is carried between said die members by said first carriage.

8. The apparatus of claim 6 wherein said support means includes second carriage means on which said laterally extending mast is mounted and base means on which said second carriage means is moveable generally transverse to said laterally extending mast.

9. The apparatus of claim 5 wherein said flexible carrier member includes conduit means delivering lubricant and compressed gas to said spray head and wherein said support means includes control means controlling said positioning means and supply of lubricant and compressed gas to said spray head through said conduit means, and including display means displaying parameters for controlling said positioning means and said supply of lubricant and compressed gas, and input means for inputting selected values of said parameters.

10. The apparatus of claim 1 wherein said guide means guiding said flexible carrier member comprises an arcuate channel and said positioning means advancing and withdrawing said flexible member comprises an arm connected to said flexible carrier member and pivoted for rotation about a center of curvature of said arcuate channel, and means for rotating said arm.

11. The apparatus of claim 10 wherein said positioning means includes mounting means mounting said guide means adjacent said die for movement between an operative position with said arcuate channel aligned with said fill chamber bore for extension of said flexible carrier member carrying said servicing member into said fill chamber bore and a stowed position clear of said die.

12. In combination with a vacuum die-casting machine having a fixed die part, a movable die part, a fill chamber having a bore opening into said fixed die part and a piston slidable in said fill chamber bore, means for lubricating the fill chamber bore comprising:

a carrier member extendable into and retractable from said fill chamber bore through said fixed die part, spray head means carried by said carrier means having multiple spray orifices circumferentially distributed about the spray head means and angularly directed radially outward and axially toward said fixed die part and away from said piston to generate an essentially continuous conical spray, and conduit means carried by said carrier member for sequentially delivering at least a liquid lubricant and then a compressed gas alone to said spray head means.

13. The combination of claim 12 wherein said spray head means includes guide means engaging said fill chamber bore and having generally helical grooves in a peripheral surface thereof directing said essentially continuous conical spray helically along said fill chamber bore toward said fixed die part.

14. In combination with a vacuum die-casting machine having a fixed die part and a movable die part and a fill chamber having a bore with a die-end opening into said fixed die part, means for lubricating the fill chamber bore comprising an arcuate channel member, means mounting said arcuate channel member adjacent said fixed die part for pivotal movement between an operative position with said arcuate channel aligned with the die-end of the bore of said fill chamber and a stowed position clear of said die parts, an elongated flexible member mounted in said arcuate channel member, means extending said elongated flexible member from said arcuate channel member into the die-end of the fill chamber bore with said arcuate channel member in the operative position, spray head means carried by said elongated flexible member into said fill chamber bore and having orifices generating a substantially conical spray directed toward the die-end of the fill chamber bore, and conduit means within said elongated flexible member selectively delivering liquid lubricant and compressed gas to said spray head means for spraying through said orifices onto the walls of the bore of said fill chamber.

15. Apparatus for lubricating a die-casting machine fill chamber bore opening at a die-end into a die, said apparatus comprising:

an elongated member, means extending said elongated member into said fill chamber bore from the die-end and then retracting said elongated member through the die-end, and lubricating means carried by said elongated member spraying said fill chamber bore with a lubricant as said elongated member is extended into said fill chamber bore and spraying said fill chamber bore with a generally conical spray of a compressed gas directed toward said die-end of said fill chamber bore as said elongated member is retracted from said fill chamber bore.

16. The apparatus of claim 15 incorporating means for adjusting a rate of application at which lubricant is sprayed on said fill chamber bore as said lubricating means is extended into said fill chamber bore.

17. The apparatus of claim 16 wherein said lubricating means comprises a spray head discharging said lubricant at a fixed discharge rate and wherein said means adjusting said rate of application comprises means controlling said means extending said elongated member into said fill chamber bore to adjust a rate at which said spray head is extended into said fill chamber bore.

18. The apparatus of claim 16 wherein said fill chamber bore is divided into a plurality of lubrication zones and wherein said means for adjusting said rate of application at which lubricant is sprayed on said fill chamber bore selectively adjusts said rate of application for each said lubrication zone.

19. The apparatus of claim 18 wherein said means for adjusting said rate of application includes display means through which values of parameters establishing said lubrication zones are selected and through which a quantity of lubricant for each said lubrication zone is selected.

20. A method of lubricating a bore of a fill chamber of a die-casting machine arranged with a die-end of the fill chamber opening into a die, said method comprising moving a servicing member into the bore of the fill chamber from the die-end of the fill chamber, and operating said servicing member to spray said bore of said fill chamber with a lubricant as said servicing member is moved into the bore of said fill chamber and to blow a gas circumferentially around said born radially outward and axially toward said die-end to create a substantially conical spray which sweeps vaporized lubricant together with any loose solder or flash out of said die-end of the bore as said servicing member is retracted from the bore of the fill chamber.

21. The method of claim 20 wherein said step of spraying comprises spraying said lubricant in a substantially conical spray directed toward said die-end of said bore of said fill chamber as said servicing member is moved into said bore of said fill chamber, and directing both said substantially conical spray of said lubricant and said substantially conical spray of said gas substantially helically along said bore of said fill chamber toward said die-end.

22. The method of claim 20 wherein said step of spraying said lubricant comprises spraying specified independent amounts of said lubricant in selected sections of said bore of said fill chamber.

23. The method of claim 22 wherein said step of spraying independent amounts of said lubricant in selected sections of said bore of said fill chamber comprises spraying lubricant at a fixed discharge rate through said servicing member and adjusting a rate at which said servicing member is moved through said selected sections of said bore in said fill chamber to discharge said specified independent amounts in each of said sections.

24. A method of lubricating the bore of the fill chamber of a die-casting machine arranged with a die-end of the fill chamber opening into a die and having a piston slidable in said bore, said method comprising moving a spray nozzle into the bore of the fill chamber from the die-end of the fill chamber while spraying a water-based lubricant onto walls of the fill chamber bore but not onto the piston, and withdrawing the spray nozzle from the fill chamber bore while spraying the walls of said bore with an outwardly directed substantially conical spray of a compressed gas.

25. A method for lubricating the bore of a fill chamber of a die-casting machine arranged with a die-end of the fill chamber opening into a die and having a fill tube in said bore, spaced form said die-end, said method comprising:

providing a servicing member movable from an at rest position during die casting operations into the fill chamber for lubrication of the bore of the fill chamber by access into the bore at the die-end of the fill chamber and terminating at a terminating position proximate the fill tube;

identifying a stroke length of the servicing member between the at rest position and the terminating position;

selecting a total quantity of lubrication to be applied within the fill chamber bore;

establishing at least first and second lubrication zones within said stroke length;

selecting a first portion of said total quantity of lubricant to be applied in said first lubrication zone; and moving said servicing member within said bore of said fill chamber while applying said total quantity of lubrication to said lubrication zones, with said first portion of said total quantity being applied in said first lubrication zone.

26. The method according to claim 25 wherein said stroke length is divided into four separate lubrication zones.

27. The method according to claim 26 wherein a beginning and an end point of each of the four lubrication zones are individually selected.

28. The method according to claim 27 including the further step of selecting the amount of lubricant to be applied in at least two of the four selected lubrication zones.

29. The method according to claim 27 wherein the four selected lubrication zones are of equal length from beginning to end point.

30. The method of claim 25 including the further step of identifying a length of travel of the servicing member from said at rest position to the beginning point of the first selected lubrication zone proximate the die-end of the fill chamber.

31. The method according to claim 25 including the step of withdrawing the servicing member from the fill chamber bore while spraying the walls of said bore with an outwardly directed substantially conical spray of a compressed gas.

32. The method according to claim 31 wherein the servicing member is withdrawn from the fill chamber at a constant velocity.

33. The method of claim 25 wherein a plurality of respective lubrication zones are established within said stroke length, wherein respective selected portions of said total quantity of lubrication are selected for said respective lubrication zones and wherein said servicing member is moved within said bore of said fill chamber while applying said respective selected portions of said total quantity of lubrication to said respective lubricating zones.

34. The method of claim 32 wherein said lubrication is discharged by said servicing member at a constant discharge rate and said servicing member is advanced through said respective lubrication zones of said bore of said fill chamber at selected respective velocities selected to apply said selected respective portions of said total quantity of lubrication to said respective lubrication zones.

* * * * *